US007127992B2

(12) United States Patent
Damm et al.

(10) Patent No.: US 7,127,992 B2
(45) Date of Patent: Oct. 31, 2006

(54) ARRANGEMENT FOR PRINTING FLAT WORKPIECES

(75) Inventors: Norbert Damm, Karlsdorf-Neuthard (DE); Gerhard Dölker, Baiersbronn (DE); Erich Schmider, Bad Rippoldsau (DE); Sascha Lämmle, Oberndorf (DE); Markus Heintel, Altensteig (DE); Bernd Armbruster, Bad Rippoldsau (DE); Tobias Schreck, Freudenstadt (DE)

(73) Assignee: Robert Burkle GmbH, Freudenstadt (DE)

( * ) Notice: Subject to any disclaimer, the term of this patent is extended or adjusted under 35 U.S.C. 154(b) by 43 days.

(21) Appl. No.: 10/899,341

(22) Filed: Jul. 26, 2004

(65) Prior Publication Data

US 2005/0051044 A1 Mar. 10, 2005

(30) Foreign Application Priority Data

Jul. 24, 2003 (DE) ..... 103 33 626

(51) Int. Cl.
*B41M 5/00* (2006.01)
*B41L 13/04* (2006.01)

(52) U.S. Cl. ..... 101/474; 101/116

(58) Field of Classification Search ..... 101/474, 101/116, 181, 183, 217, 158, 484, 233, 251, 101/485, 216, 486
See application file for complete search history.

(56) References Cited

U.S. PATENT DOCUMENTS 4,411,194 A * 10/1983 Davidson, Jr. ..... 101/216
4,986,526 A * 1/1991 Dastin ..... 271/227
5,056,430 A * 10/1991 Bayerlein et al. ..... 101/211
5,181,257 A * 1/1993 Steiner et al. ..... 382/162
5,327,826 A * 7/1994 Rodi ..... 101/181
5,335,595 A * 8/1994 Yamashita et al. ..... 101/158
5,353,703 A * 10/1994 Rieker ..... 101/177
5,380,109 A * 1/1995 Eckert et al. ..... 400/708
5,385,091 A * 1/1995 Cuir et al. ..... 101/217
5,392,710 A * 2/1995 Li ..... 101/219
5,526,107 A * 6/1996 Bronstein ..... 399/299

(Continued)

FOREIGN PATENT DOCUMENTS

DE 694 00 007 12/1995

(Continued)

*Primary Examiner*—Daniel J. Colilla
*Assistant Examiner*—Wasseem H. Hamdan
(74) *Attorney, Agent, or Firm*—Volpe and Koenig, PC

(57) ABSTRACT

An arrangement for printing flat workpieces is provided and includes an application roller which rolls on the workpiece surface 6 to be printed and thereby applies a printed image to the workpiece surface 8, the application roller forming a printing cylinder 5 or a transfer roller 1 cooperating with a printing cylinder 5, a counter-roller 2 which forms in cooperation with the application roller a printing gap 3, through which the workpiece 4 passes during the printing process, and a transport device 7 for feeding the workpiece 4 into and out of the printing gap 3 formed by the application roller and the counter-roller 2. A detector device 8 is present in the direction of transport of the workpiece 4, before the printing gap 3, for detecting the position of a workpiece front end 9 or an image beginning mark, and cooperates with the transport device 7, 11 and/or the printing cylinder 5; wherein the transport of the workpiece 4, prior to reaching the printing gap 3, is accelerated or delayed and/or the angular position of the printing cylinder 5 can be changed by accelerating or delaying its rotational motion in order to bring into agreement the beginning of the printed image with the workpiece front end 9 or a determined relative position thereof.

23 Claims, 3 Drawing Sheets

U.S. PATENT DOCUMENTS

| | | | | |
|---|---|---|---|---|
| 5,555,084 | A * | 9/1996 | Vetromile et al. | 399/16 |
| 5,725,211 | A * | 3/1998 | Blanchard et al. | 271/265.02 |
| 5,828,937 | A * | 10/1998 | Aerens et al. | 399/301 |
| 6,014,542 | A * | 1/2000 | Hozumi et al. | 399/394 |
| 6,029,572 | A * | 2/2000 | Rodi | 101/215 |
| 6,041,705 | A * | 3/2000 | Lintner | 101/116 |
| 6,373,042 | B1 * | 4/2002 | Kretschmann et al. | 250/208.1 |
| 6,374,075 | B1 * | 4/2002 | Benedict et al. | 399/395 |
| 6,539,859 | B1 * | 4/2003 | Williams | 101/175 |
| 6,705,222 | B1 * | 3/2004 | Norman et al. | 101/248 |
| 6,718,879 | B1 * | 4/2004 | Dreher et al. | 101/485 |
| 6,782,818 | B1 * | 8/2004 | Glockner et al. | 101/228 |
| 6,826,384 | B1 * | 11/2004 | Dobbertin et al. | 399/394 |
| 6,869,241 | B1 * | 3/2005 | Ouchi et al. | 400/578 |
| 2004/0215411 | A1 * | 10/2004 | Howe | 702/85 |

FOREIGN PATENT DOCUMENTS

| | | |
|---|---|---|
| DE | 195 23 879 | 1/1997 |
| DE | 196 26 821 | 1/1998 |
| DE | 197 29 513 | 1/1999 |
| DE | 198 26 974 | 12/1999 |
| JP | 61 144 351 A | 7/1986 |
| WO | WO 98/01302 | 1/1998 |

* cited by examiner

ARRANGEMENT FOR PRINTING FLAT WORKPIECES

BACKGROUND

The invention relates to a device for printing flat workpieces.

Such devices generally include an application roller which rolls on the workpiece surface to be printed, and accordingly prints a printed image on the workpiece surface directly or indirectly, according to whether the application roller itself is constructed as a printing cylinder, or cooperates as a transfer roller with such, and applies a printed image to the workpiece surface, and also a counter-roller which, in cooperation with the application roller, forms a printing gap through which the workpiece passes during printing. Furthermore, a transport device is present for feeding the workpiece into and out of the printing gap formed by the application roller and the counter-roller.

In particular, to give derived wood product panels the appearance of real wood, on cost grounds as against real wood veneer or foil coatings, printed images of decorations and wood veining are directly applied to the derived wood product panels.

For the highest quality improved appearance, a single color printing is of course not suitable. Rather, it is desired to apply the veining or decoration to the material panel in multicolor printing. This is not only the case for derived wood products; uses for other materials which can be qualitatively improved by surface printing, such as for example brick or artificial leather, can be upgraded by multicolor printing.

However, specifically for a high-value multicolor printing, it is indispensable that the printed image is positioned on the workpiece within very close tolerances, typically in the region of ±0.1 mm. Only thus can an optical quality comparable with conventional foil coatings be attained.

These requirements are of course more difficult to maintain with the present flat workpieces than in machines for paper or foils, because the flat workpieces here do not run endlessly through the printing machine, and printing according to the pattern of paper sheet printing machines is in all cases not possible, because of the inflexibility of the flat workpieces concerned.

SUMMARY

The present invention therefore has as its object to improve an arrangement for printing flat workpieces of the kind mentioned at the beginning so that the printed image is positioned more accurately than possible heretofore on the workpiece surface.

This object is attained by an arrangement with the features according to the invention. Advantageous embodiments and developments of the invention are noted below.

The measures according to the invention for improving an arrangement of the category concerned thus are provided in that, seen in the transport direction of the workpiece, a detector for position detecting of a workpiece front edge or an image beginning mark is present, and that this is embodied to cooperate with the transport device and/or the printing cylinder such that the transport of the workpiece is accelerated or delayed before reaching the printing gap, and/or the angular position of the printing cylinder can be changed by accelerating or delaying its rotational motion, in order to bring the beginning of the printed image into agreement with the front edge of the workpiece or a determined length therefrom.

It is important that through the detector device an unambiguous position determination of the front edge of the workpiece is possible relative to the angular position of the printing cylinder, and is known in the control of the machine, so that taking into account the fixed distance between the detection location and the printing gap, the position of the beginning of the printed image from the workpiece can be precisely calculated and if necessary corrected by briefly braking or accelerating the transport motion of the printing cylinder. A combination of both measures is of course also possible.

The invention has particular advantages when plural transport rollers, possibly with a counter-roller, and a transport device are arranged in line one behind the other, as is the rule for multi-color printing. The workpiece then passes successively in one working step through all the printing gaps formed between the application rollers and the counter-rollers, and is printed with another color in each printing gap. This continuous linear process requires a synchronous transport through the plant by means of a master position control. Likewise, each printing gap is provided with its own upstream detector device for position detection of the workpiece front edge or the image beginning mark, and each printing cylinder, or the transport device directly allocated to this, can be briefly accelerated or delayed, based on the detected sensor values, in order to synchronize the image beginning with the workpiece and if necessary to correct displacements lying outside the predetermined tolerances. The information from the detector devices is then used to generate a correcting engagement with selected drives of the master controlled synchronized interconnected arrangement.

The modular construction of a multicolor printing line ensures that the attainable position accuracy of the printed image on the workpiece surface does not depend on the number of printers connected one behind the other. The modular construction furthermore makes it possible that individual printers can travel out transversely to the printing line in order to perform a change of color or rollers. When at the same time a single distance path is traveled in the printing line, it is not necessary for production to be appreciably interrupted.

There are particular advantages in a printing line with plural printers according to the invention if a supply sensor is provided before the first application roller for position detection of the workpiece front edge or an image beginning mark and an acceleration or delaying of the advancement along the path cooperating with this is provided for coarse alignment of the workpiece on the printed image position of the first printing cylinder. The modular correction possibility before each further printing gap is then only required to undertake fine adjustment and fine correction.

In the course arranged before the printing line, a longer path can be provided for accelerations or delays of the workpiece, which is of course suitable for the coarse alignment of the workpiece. In order to ensure defined ratios in coarse alignment in each case, the acceleration path can substantially be formed by a calender, which clamps the workpiece passing through in a defined manner and thus can transfer to the workpiece the position correction provided by the control without further friction.

In the present technology of printing flat workpieces, in particular derived wood product panels, the panels as a rule first pass through other processing stations in line before they reach the supply sensor for coarse alignment in the device according to the invention. This makes it difficult to synchronize the delivery of the individual workpieces just at the beginning of the processing line with the printing line, particularly with the necessary accuracy. On the one hand, since the delivery position for the workpieces is as a rule at a far distance spatially and thus otherwise has to satisfy no precision requirements. On the other hand, the processing stations before the printing line are constant error sources for the position and alignment of the flat workpieces. A very uniform sequence of the workpieces on the transport device and during forwarding to the printing line is nearly impossible as a result.

A printing line having a plurality of printers, with respectively a control circuit according to the invention for modular correction of the beginning of the printed image, forms a system which can oscillate, because of the repeatedly occurring control processes with each arriving workpiece. The preferably provided coarse alignment of the workpieces before reaching the printing line proper keeps the oscillation amplitude small here and prevents a possible instability. The individual control circuits of the printing gaps must then undertake only small corrections.

The coarse alignment also prevents two workpieces following too closely one after the other for the individual printing gaps to be fine adjusted separately from each other. The coarse adjustment normally seeks to ensure that the distance between the individual workpieces is an integral multiple of the image length provided.

The coarse alignment of the workpieces which is preferably present is decoupled by the advance sensor and the acceleration path, and thus the printing line is decoupled from the normally preceding work stations. The coarse alignment preferably works, in particular, so that the workpieces are basically accelerated and not braked, since a delay would risk a jamming up of the production line.

Both the application roller and also the counter-roller can be provided with a respective drive, as is heretofore usual. To increase the accuracy of the image application to the workpiece surface and also to prevent undesired image distortion, it is advantageous if the drive of the counter-roller gives a smaller torque than that of the application roller. It can thus be ensured that the application roller rolls without slipping on the workpiece surface. Alternatively, it can be provided that the drive of the counter-roller can be controlled in dependence on the possibly present image distortions, in order to produce or eliminate in a targeted manner, slippage between the application roller and the workpiece.

The image length during printing depends directly on the slippage of the application roller on the workpiece, or apart from this on the slippage between the application roller and the transmission roller. The aim in printing is therefore the prevention of slippage, but still more important is the correctly positioned superposition of the different colors, when printed successively in printing gaps following in succession. According to a particularly preferred embodiment of the invention, therefore, a drive of a roller of a printing gap, appropriately the drive of the application roller, is chosen as the master drive and its torque is taken as the reference value. All other drives of a printing gap cooperating with this drive are controlled so that the values of their torques are kept positive in all circumstances, thus no null transitions of the torque take place. This can be attained in the simplest manner by a kind of torque cascade, and thus by a known choice of the torque of all drives with respect to the master torque. By the prevention of null transitions, it is attained that all drive trains of the drive run play-free, since they are permanently kept "under load". Oscillations in the drive trains due to tooth flank play, coupling play, torsion, etc., which would result in image distortions, are hereby excluded in the simplest manner, without great control cost or measurement of absolute values. Also fluctuations in effective radius of the rollers taking part due to the elasticity of the roller surface and the thickness tolerances of the workpieces, because of this measure of torque control cannot lead to image distortions, and in particular to different image distortions for different colors.

In order also to be able to maintain the close position tolerances for the printing in the lateral direction, a lateral guide for the workpieces can be present, the workpieces being transported through the device in abutment with this guide. The workpieces are exactly aligned laterally in this manner.

This lateral guide can be formed of a simple straight edge, but better, a roller path or a vertical conveyor belt. At the same time, it is advantageous if means to exert a transport force component for the workpiece, perpendicular to the transport direction and to the transport force components oriented perpendicular to the toward the lateral guide, are present. Such means can for example include a skew set of rollers, a small crossing together of counter-roller and application roller in the horizontal axial position, or a small skew position relative to the passage direction.

For fine adjustment if the axial position of the workpieces, the printing cylinder can be made axially displaceable. This transverse displacement of the printing cylinder can also take place automatically by feedback from an image detection system, in that the image detection system detects a need for correction of the printed image transferred to the workpiece surface and feeds this back to the axial displacement of the printing cylinder.

Further particular advantages arise when the application roller is provided with a drive which is controllable to produce or eliminate slippage between the application roller and the workpiece and/or possibly between the printing cylinder and the application roller constructed as transmission roller. The position detection, according to the invention, of the workpiece forward edge or of an image beginning mark relative to the position of the printed image first affects only the exact position of the beginning of the printed image on the workpiece surface. The printed image length and thus the position of the image end is on the other hand dependent on the relative speed between the application roller and the workpiece surface or, with indirect printing, also on the relative speed between the printing cylinder and the transmission roller. Only when these relative speeds are exactly equal to zero, and thus no slippage is present, the printed image is transferred at a scale of 1:1 to the workpiece surface. Slippage and hence inaccuracies in the printed image are produced by different parameters, e.g. the initial printing setting of the application roller, the workpiece thickness tolerance, or the inhomogeneity of the application roller surface. Production of a "counter-slip" between the application roller and the workpiece or between the printing cylinder and a possibly present transmission roller can eliminate these disturbance variables and keep the printed image length nearly at the level of 1:1 imaging.

In contrast to the adjustment of the printed image beginning on the workpiece surface according to the invention, slippage occurring between the application roller and the workpiece, or between the printing cylinder and an application roller provided as a transmission roller, acts for first compensating errors in the printed image length on the following workpiece; thus a tendency correction is concerned here.

The detection of printed image length errors according to the printing which has occurred and the corresponding correction by production or elimination of a slippage can take place by eye and hand. However, it is advantageous if means for detecting image length tolerances follow the printing gap, and preferably is provided by a digital camera. When an image processing device is then also present, the control of the application roller using the digital image obtained from the camera acts on the control of the application roller in order to compensate for image length tolerances, giving an automatic control system which reduces the image length tolerances below a minimum amount.

As already mentioned hereinabove, the digital camera and the allocated image processing device can also detect a tolerance observance in the lateral direction and correct by an axial displacement of the printing cylinder.

In particular, derived wood product workpieces have thickness tolerances which usually do not permit a direct printing with a printing cylinder. Hence the application roller is not formed as a printing cylinder, but a separate printing cylinder is present, which transfers the printed image onto the workpiece surface. The application roller is thus then provided as a transfer roller. The printing cylinder is preferably an engraved roller with depressions which fill with dye in the inking device, while it subsequently gives this up to the transfer roller. The transfer roller is here appropriately formed as a rubber-coated steel roller, the rubber surface of which is ground flat.

The application roller thus provided as a transfer roller is then located in simultaneous contact with the printing cylinder and the workpiece surface, while it takes over the printed image from the printing cylinder and transfers it to the workpiece.

As already mentioned hereinabove, for printed image length adjustment, a slippage between the printing cylinder and the application cylinder or the transfer roller can alternatively or additionally be produced. Then an inadvertent slippage which may be present between the printing cylinder and the transfer roller results in slight printed image distortions, which finally leads to errors in the printed image length.

Insofar as a digital camera for image detection and an image processing device are present, the latter can act on the control of the printing cylinder and/or the application roller, in order to compensate image length tolerances. This measure leads to an automatically controlled error correction process as regards printed image length.

In order to further increase quality improvement of the printed surface, it can be advantageous to coat this with a melamine resin and to perform a subsequent embossing of the printed and coated workpiece, for example with an embossing roller or press. This embosses into the surface a structure which must of course exactly correspond to the previously applied printed image, in order to attain the envisaged effect. Accordingly, an embossing device can be provided which follows the printing gap formed by the roller and the counter-roller.

When in an arrangement according to the invention at least two detection devices are provided, spaced apart in the transport direction, these two can be used, not only for position detection, but also for measuring the present transport speed of the workpiece. When the arrangement according to the invention contains not only one printing gap but plural printing gaps one after the other, in which besides each printing unit is provided with its own detector unit according to the invention, two such individual detector devices can cooperate for measuring the transport speed.

BRIEF DESCRIPTION OF THE DRAWINGS

An exemplary embodiment of the invention is described hereinafter using the accompanying drawings and is explained in detail.

DETAILED DESCRIPTION OF THE PREFERRED EMBODIMENT

Figure 1:
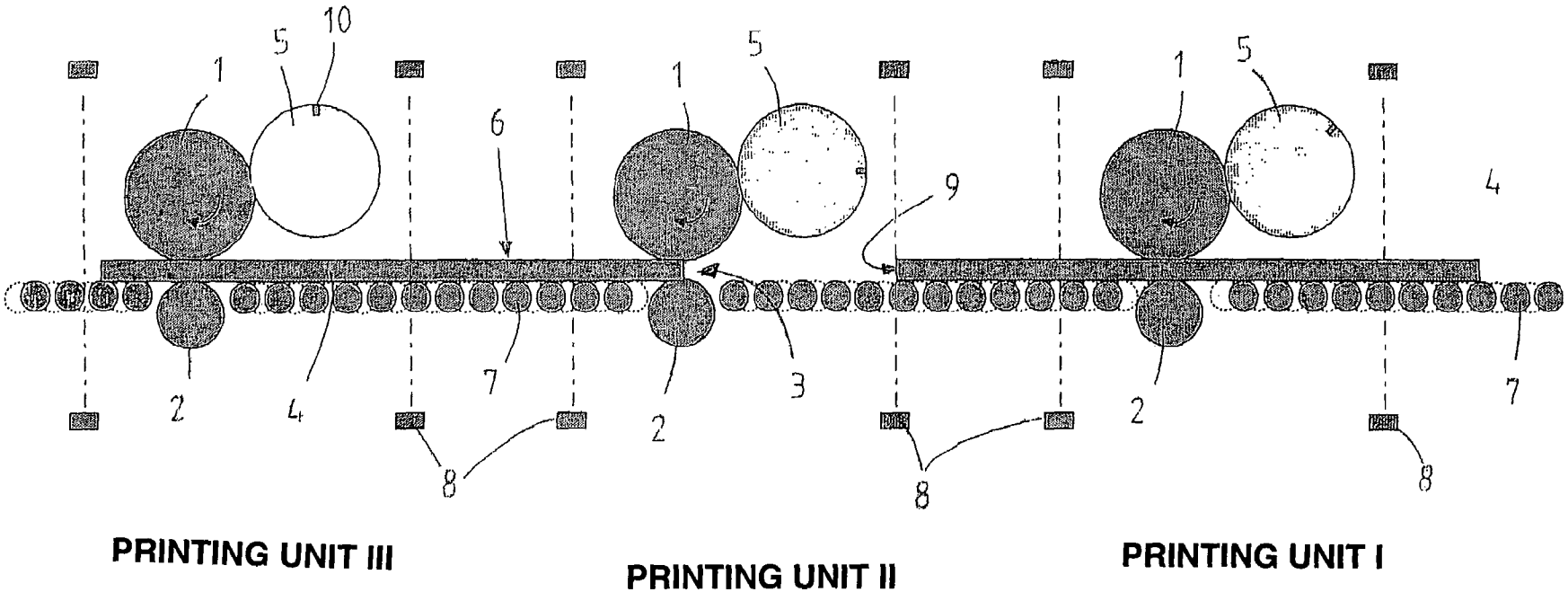
FIG. 1 is a schematic side view of a device according to the invention with three printing units.

FIG. 1 shows a total of three application rollers, provided as transfer rollers 1 for indirect printing, respectively cooperating with a counter-roller 2 and forming a printing gap 3 through which a workpiece 4 passes. The printed image is respectively transferred from a printing cylinder 5 to the transfer roller 1 and from this to the workpiece surface 6.

The workpiece 4 runs on a roller conveyor 7, the transfer roller 1, the counter-roller 2 and the printing cylinder 5 being respectively synchronously driven and hereby also producing the transport motion of the workpiece.

At least one detector device 8 constructed as an optical sensor for detection of a distance of the front edge 9 of the workpiece 4 is arranged before each printing gap 3. This allows any necessary correcting action in order to perform the positioning of the front end 9 relative to the angular position of the printing cylinder 5, by briefly accelerating or delaying the printing cylinder 5 and the transfer roller 1. In order also to be able to monitor in real time the present transport speed of the printing line shown in FIG. 1, here respectively two detection devices 8 are present for position determination of the front edge 9 of the workpiece 4.

The printing cylinders 5 are respectively provided with a reference mark 10, by means of which a marking arranged near the printed image can be placed in a known manner on the workpiece surface. This reference marking, as a rule a colored cross or a colored light, makes possible a very rapid detection of imaging errors, which is particularly important for printed image length correction according to the invention. Reference marks, and if necessary printed marks placed near them, can also be detected without problems by a digital camera and automatically evaluated. Reference marks are preferably set both at the image beginning and the image end, the first so that the tolerances of the printed image beginning and the last so that the tolerances of the printed image length can be tested for maintenance.

Figure 2:
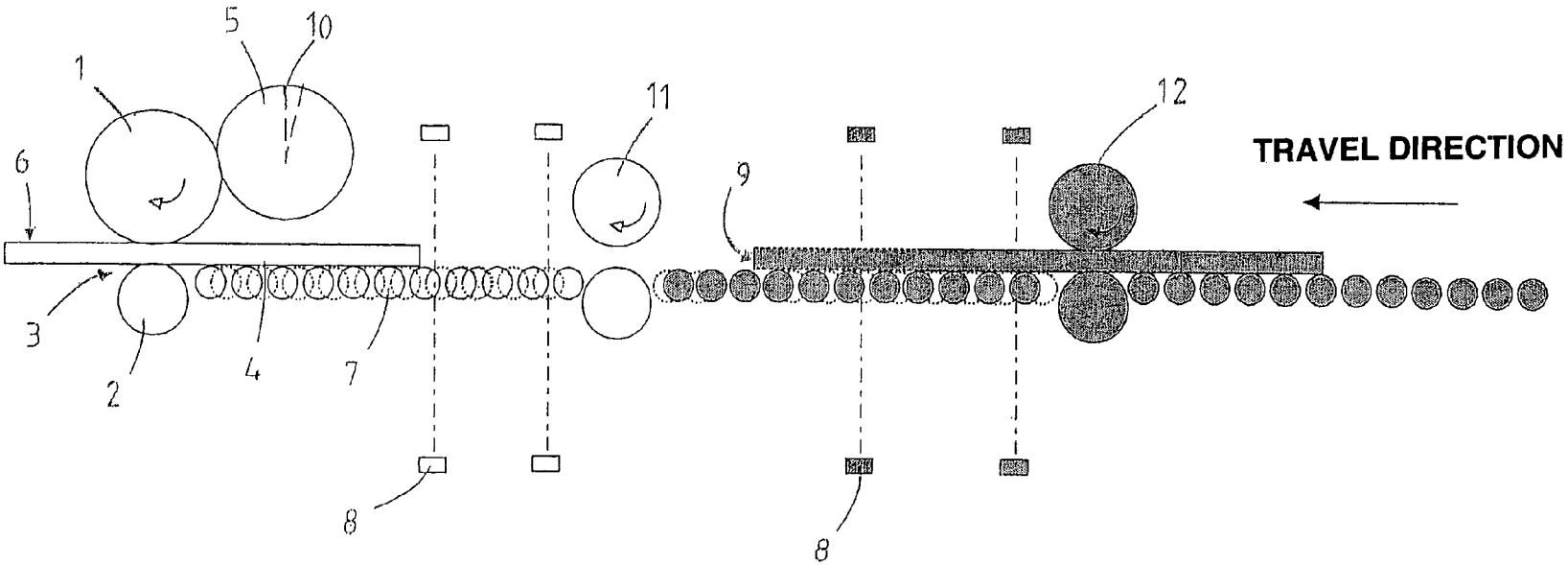
FIG. 2 is a similar illustration of the supply unit of the device of FIG. 1.

FIG. 2 finally shows the supply unit of the device shown in FIG. 1, a device being present here for coarse alignment of the workpiece 4. It is furthermore clear that a calender 11 is connected before the first printing unit in order to perform in a targeted and reproducible manner the acceleration or braking of the workpiece 4.

The device for coarse alignment also has a calender 12 which defines, and effects without friction, the braking or acceleration of the workpiece 4.

The calender 11 acts as an acceleration or delaying path for the first printing unit, so that the drive of the application roller or here of the transfer roller 1 and of the counter-roller 2 do not necessarily have to be controlled for correction purposes.

Figure 3:
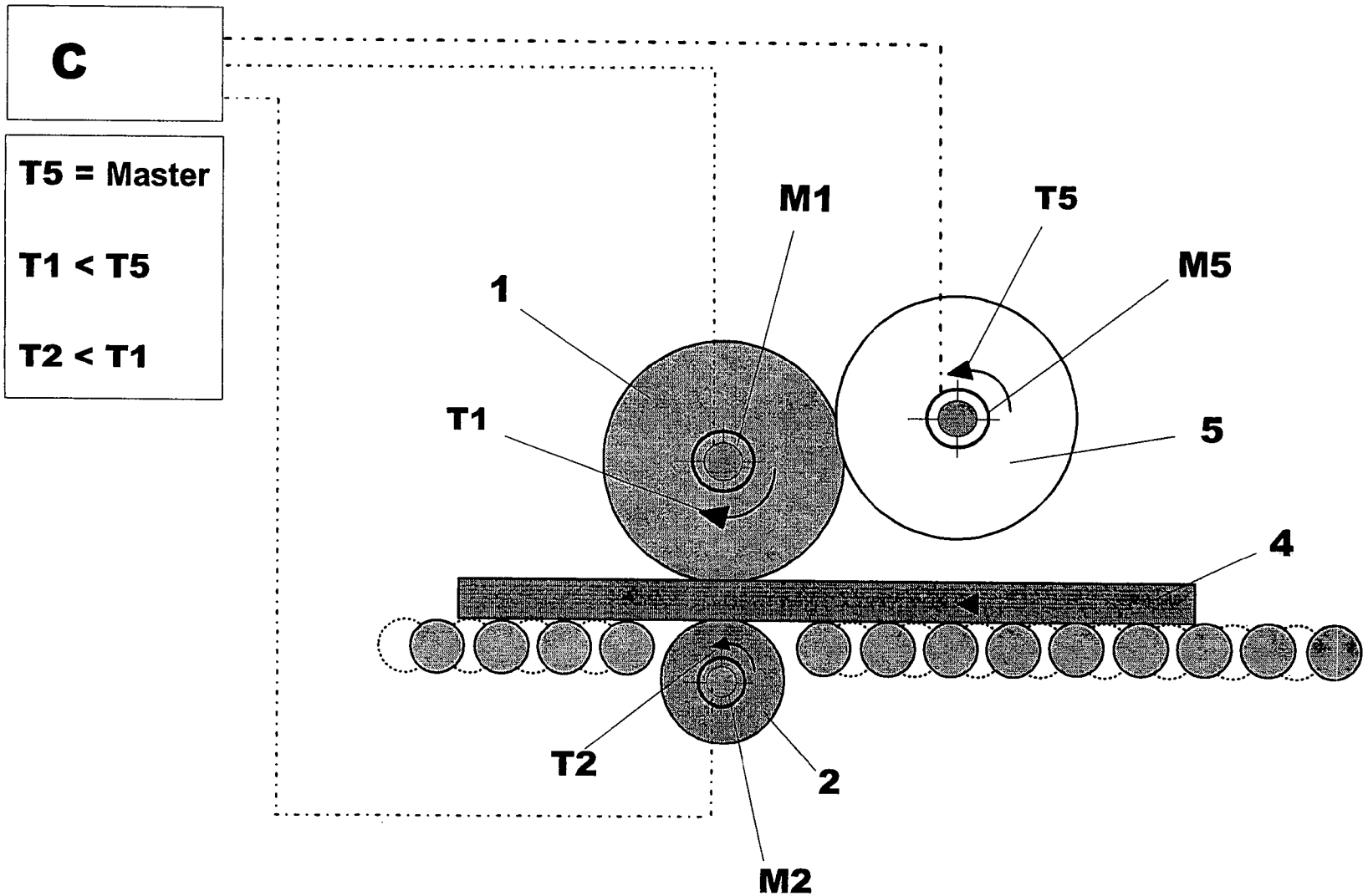
FIG. 3 is a portion of the device of FIG. 1 showing one of the three printing units.

Referring also now to FIG. 3, a single one of the three printing units of FIG. 1 is shown. The transfer roller 1 is connected to a drive motor M1, the counter roller 2 is connected to a drive motor M2, and the printing cylinder 5 is connected to a drive motor M5. Preferably, during operation, the transfer roller drive motor M1, the counter roller drive motor M2, as well as any additional drive motors associated with the printing gap 3, are controlled such that one of the drive motors is configured with a preset torque value, and the remaining drive motors are configured to provide a torque such that there are no sign changes of the torque value (i.e. positive torque is maintained) during the printing process. For example, in the preferred embodiment diagrammatically shown in FIG. 3, the counter roller drive motor M2 produces a torque T2 which is less than the torque T1 of the transfer roller drive motor M1. Accordingly, the transfer roller 1 can roll without slipping on the surface of the workpiece 4. Alternatively, the counter roller drive motor M2 can be controlled based on detected image distortions in order to produce or eliminate in a targeted manner slippage between the transfer roller 1 and the workpiece 4.

Finally it should be remarked that particularly for derived wood products, but also for other non-flexible workpieces, it becomes appropriate to use the principle of indirect printing as described using the exemplary embodiments shown in the Figures; here the printed image is transferred from the printing cylinder 6 to the transfer roller 1 and from this then to the workpiece surface 4. Likewise, the invention can also be used with direct printing; the transfer roller 1 would in this case be omitted, and the printing cylinder 5 would be used directly as application roller and roll on the workpiece surface 6.

LIST OF REFERENCE NUMERALS

1 transfer roller
2 counter-roller
3 printing gap
4 workpiece
5 printing cylinder
6 workpiece surface
7 roller conveyor
8 detection device
9 workpiece front edge
10 reference mark
11 calender
12 calender

The invention claimed is:

1. Arrangement for printing flat workpieces (4) comprising:

an application roller which rolls on the workpiece surface (6) to be printed and thereby applies a printed image to the workpiece surface (8), the application roller including at least one of a printing cylinder (5) and a transfer roller (1) cooperating with a printing cylinder (5);

a counter-roller (2) which forms in cooperation with the application roller a printing gap (3) through which the workpiece (4) passes during the printing process;

including a first drive connected to at least one of the application roller and the counter-roller which is controllable for producing or eliminating slippage between the application roller and the workpiece (4);

a transport device (7) for feeding the workpiece (4) into and out of the printing gap (3) formed by the application roller and the counter-roller (2); and a detection device (8) that detects a position of a workpiece front end (9) or an image beginning mark located before the printing gap (3) in a direction of transport of the workpiece (4), the detection device configured to cooperate with at least one of the transport device (7, 11) and the printing cylinder (5) so that the transport of the workpiece (4), prior to reaching the printing gap (3), is accelerated or delayed and/or an angular position of the printing cylinder (5) is changed by accelerating or delaying a rotational motion thereof in order to bring into agreement a beginning of the printed image with the workpiece front end (9) or a determined relative position thereto.

2. Arrangement according to claim 1, wherein there are a plurality of application rollers, each having a respective counter-roller (2) and transport device (7, 11) arranged in like one behind the other; each of the printing gaps (3) having allocated thereto a respective detection device (8) for position detection of the workpiece front edge or the image beginning mark, the transport devices (7, 11) are matched to one another such that the workpiece (4) runs one after the other through all printing gaps (3) formed between the application rollers and the counter-rollers (2) in one working step.

3. Arrangement according to claim 2, wherein a supply sensor (8) is provided for position detection of the workpiece front edge (9) or of the image beginning mark, and an acceleration or delaying path (12) is provided which is responsive to the supply sensor for coarse alignment of the workpiece (4) with the printed image position of a first printing cylinder (6).

4. Arrangement according to claim 3, wherein the acceleration path includes a calender (12).

5. Arrangement according to claim 3, wherein the supply sensor (8) controls a delivery device which delivers the workpieces (4) to the transport device (7).

6. Arrangement according to claim 1, wherein another one of the at least one of the application roller and the counter-roller (2) is provided with a second drive which produces a smaller torque than that of the application roller.

7. Arrangement according to claim 1, wherein the application roller and the counter-roller (2) and also if necessary further rollers of a printing gap (3) are each provided with a respective drive including the first drive, the drives being controlled such that one of the drives is a master drive which presets a master torque value and all other drives are controlled to have a respective torque such that there are no sign changes of the torque value (i.e. positive torque is maintained) during the printing process.

8. Arrangement according to claim 7, wherein the drives controlled according to the preset value of the torque of the master drive are respectively acted on by a torque which respectively lies at least slightly below the master torque.

9. Arrangement according to claim 1, wherein another one of the at least one of the application roller and the counter-roller (2) is provided with a second drive controllable for producing or eliminating a slippage between the application roller and the workpiece (4).

10. Arrangement according to claim 1, further comprising a guide for laterally guiding the workpiece (4).

11. Arrangement according to claim 10, wherein the guide is formed by a straightedge, a roller conveyor, or a vertical conveyor belt.

12. Arrangement according to claim 10, further comprising means for producing a transport force component perpendicular to the transport direction and for lateral guiding for the workpiece (4).

13. Arrangement according to claim 1, wherein the printing cylinder is axially displaceable for transverse adjustment of the printed image.

14. Arrangement according to one claim 1, wherein a detector for detecting image length tolerances is provided following the printing gap(3).

15. Arrangement according to claim 14, wherein the detector for image length tolerances comprises a digital camera.

16. Arrangement according to 1, further comprising an image processing device which acts on the first drive of the application roller and/or of the counter-roller (2) drive to compensate for image length tolerances.

17. Arrangement according to claim 16, wherein the image processing device also acts on a control for axial displacement of the printing cylinder (5).

18. Arrangement according to claim 1, wherein the printing cylinder (5) is an engraved roller.

19. Arrangement according to claim 1, wherein the application roller includes the first drive and further comprises a transfer roller (1) which is provided with a transfer roller drive; the printing cylinder (5) is provided with a printing cylinder drive; and the drive of the transfer roller (1) and/or the drive of the printing roller (5) is controllable, in order to produce or eliminate slippage between the printing cylinder (5) and the transfer roller (1).

20. Arrangement according to claim 19, further comprising an image processing device including a digital camera to obtain a digital image, the image processing device acts on the a control of the printing cylinder (5) and/or the transfer roller (1) in order to compensate image length tolerances.

21. Arrangement according to claim 1, wherein the printing gap (3) is followed by an embossing device.

22. Arrangement according to claim 1, wherein the workpiece (4) comprises a wood or a derived wood product.

23. Arrangement according to claim 1, wherein at least two detector devices (8) are provided, spaced apart in the transport direction of the workpiece (4), and arranged to mutually cooperate to determine the transport speed of the workpiece (4).

* * * * *